US006591521B2

(12) United States Patent
Brown

(10) Patent No.: US 6,591,521 B2
(45) Date of Patent: Jul. 15, 2003

(54) DIPPER DOOR AND DIPPER DOOR ASSEMBLY

(75) Inventor: Robert F. Brown, Racine, WI (US)

(73) Assignee: Bucyrus International, Inc., South Milwaukee, WI (US)

( * ) Notice: Subject to any disclaimer, the term of this patent is extended or adjusted under 35 U.S.C. 154(b) by 0 days.

(21) Appl. No.: 09/963,979

(22) Filed: Sep. 26, 2001

(65) Prior Publication Data

US 2002/0040540 A1 Apr. 11, 2002

Related U.S. Application Data

(60) Provisional application No. 60/238,171, filed on Oct. 5, 2000.

(51) Int. Cl.[7] ..... E02F 3/30
(52) U.S. Cl. ..... 37/445; 414/726
(58) Field of Search ..... 37/397, 398, 442, 37/444, 445; 414/718, 719, 720, 724, 726

(56) References Cited

U.S. PATENT DOCUMENTS

| | | | | |
|---|---|---|---|---|
| 1,629,634 A | | 5/1927 | Orndorff | |
| 1,712,040 A | | 5/1929 | Houghton | |
| 2,434,902 A | | 1/1948 | Burdick | 214/146 |
| 2,959,305 A | * | 11/1960 | Konefes | 37/444 |
| 3,208,610 A | | 9/1965 | Logus | 214/140 |
| 3,209,474 A | | 10/1965 | Artman | 37/117.5 |
| 3,341,041 A | | 9/1967 | Salna | 214/145 |
| 3,869,054 A | | 3/1975 | Moreau | 214/146 |
| 4,006,832 A | | 2/1977 | Auxer et al. | 214/146 |
| 4,063,373 A | | 12/1977 | Greer et al. | 37/115 |
| 5,469,647 A | * | 11/1995 | Profio | 37/398 |
| 5,590,482 A | | 1/1997 | Peterson et al. | 37/403 |
| 5,613,308 A | | 3/1997 | Little | 37/445 |
| 5,815,958 A | | 10/1998 | Olds et al. | 37/444 |
| 5,815,960 A | | 10/1998 | Soczka | 37/445 |
| 5,974,705 A | | 11/1999 | Isley et al. | 37/444 |

FOREIGN PATENT DOCUMENTS

| | | | |
|---|---|---|---|
| DE | 697 260 C | 10/1940 | 84/3 |
| DE | 10 41 877 B | 10/1958 | 84/3 |
| DE | 34 02 269 A | 8/1985 | E02F/3/40 |
| WO | 97 41312 A | 11/1997 | E02F/3/407 |

* cited by examiner

*Primary Examiner*—Robert E. Pezzuto
(74) *Attorney, Agent, or Firm*—Quarles & Brady LLP

(57) ABSTRACT

A dipper assembly includes a dipper having an open bottom and forward end, and a door pivotally linked to the dipper. The dipper bottom is defined by dipper wall bottom edges. The door has a bottom wall and side walls which extend above the bottom wall to define a volume between the side walls, wherein top edges of the side walls abut bottom edges of the dipper wall bottom edges to close the dipper bottom.

10 Claims, 4 Drawing Sheets

DIPPER DOOR AND DIPPER DOOR ASSEMBLY

CROSS REFERENCES TO RELATED APPLICATIONS

This application claims the priority benefit of U.S. Provisional Patent Application No. 60/238,171 filed on Oct. 5, 2000.

STATEMENT REGARDING FEDERALLY SPONSORED RESEARCH

Not Applicable.

BACKGROUND OF THE INVENTION

This invention relates to dippers for large shovels, and particularly to a dipper door and dipper assembly including a door.

Shovel dipper assemblies include a dipper formed with teeth at their leading edge and a flat dipper door. The door closes the dipper open bottom, and holds earth and other load materials that are loaded into the dipper by the action of the shovel. Structural elements, such as sides, and rear walls are disposed beneath the door or overlap the outer surface of the dipper walls to strengthen the door. The volume of the dipper assembly is defined by dipper walls.

The dipper door must be held closed while the dipper is being loaded and while the load in the dipper is swung to a deposit point. At that point, the dipper door must be opened to allow the contents of the dipper to fall out. Conventionally, the locking of the dipper door is accomplished by a mechanical latch which holds the door in a closed position and which is released by a cable to allow the door to swing open under its own weight and the weight of the contents of the dipper. The door is relatched by allowing it to swing closed. An example of such a mechanical latch is found in U.S. Pat. No. 5,815,958 issued Oct. 6, 1998, for "Excavator Dipper Latch Assembly Having Removable Tapered Latch Bar".

The dipper door structural elements are required to provide sufficient structural integrity to support the load material in the dipper when the door is closed. The door structural elements increase the weight of the door, and thus the entire weight of the dipper assembly. A need exists to reduce the weight of the dipper assembly without reducing the volume for load material of the assembly.

SUMMARY OF INVENTION

The present invention reduces the weight of a dipper assembly by providing a dipper door having structural members which define a volume for holding load material. The volume of the dipper door allows the dipper volume to decrease by removing dipper material (such as by shortening the dipper walls) while maintaining the same volume for the dipper assembly. Reducing the dipper volume reduces the weight of the dipper, and thus the assembly.

The dipper assembly includes a dipper having an open bottom and forward end, and a door pivotally linked to the dipper. The dipper bottom is defined by dipper wall bottom edges. The door has a bottom wall and side walls which extend above the bottom wall to define a volume between the side walls, wherein top edges of the side walls abut bottom edges of the dipper wall bottom edges to close the dipper bottom.

In one aspect of the present invention, the door is pivotally mounted to the dipper at a pivot point offset a distance from the open bottom in a direction toward the forward end. The door can include a back wall extending upwardly from a back edge of the bottom wall and joined at each end to the door sidewalls, wherein a top edge of the door back wall abuts one of the dipper wall bottom edges.

The foregoing and other objects and advantages of the invention will appear in the detailed description which follows. In the description, reference is made to the accompanying drawings which illustrate preferred embodiments of the invention.

DETAILED DESCRIPTION OF THE PREFERRED EMBODIMENT

Figure 1:
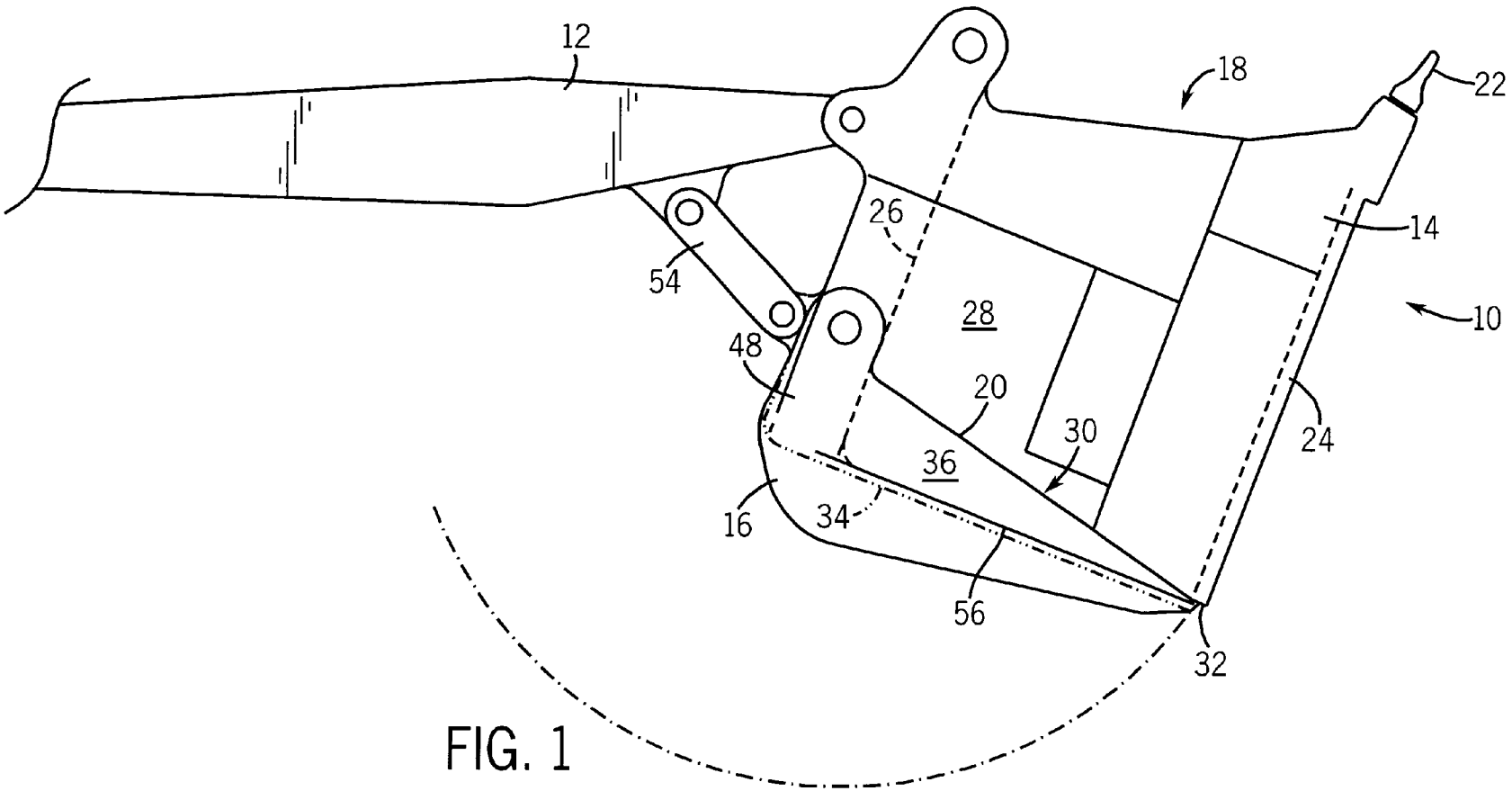
FIG. 1 is a side view of a dipper assembly incorporating the present invention.

Referring to FIGS. 1–4, a dipper assembly 10 is pivotally mounted to an end of a dipper arm 12. The dipper assembly 10 defines a volume for holding load material, and includes a dipper 14 and dipper door 16. The dipper has an open forward and bottom end 18, 20. The forward end 18 has forwardly projecting teeth 22. The bottom end 20 is closed by the pivotally mounted dipper door 16 which defines a portion of the volume of the dipper assembly 10.

The dipper 14 has a front wall 24, a back wall 26, and side walls 28. Bottom edges 30 of the dipper side walls 28 extend downwardly at an angle from the back wall 26 toward the front wall 24, and are joined by bottom edges 32 of the back wall and front wall to define the dipper bottom. The dipper walls 24, 26, 28 define a volume for holding load material when the door 16 is closed.

Figure 2:
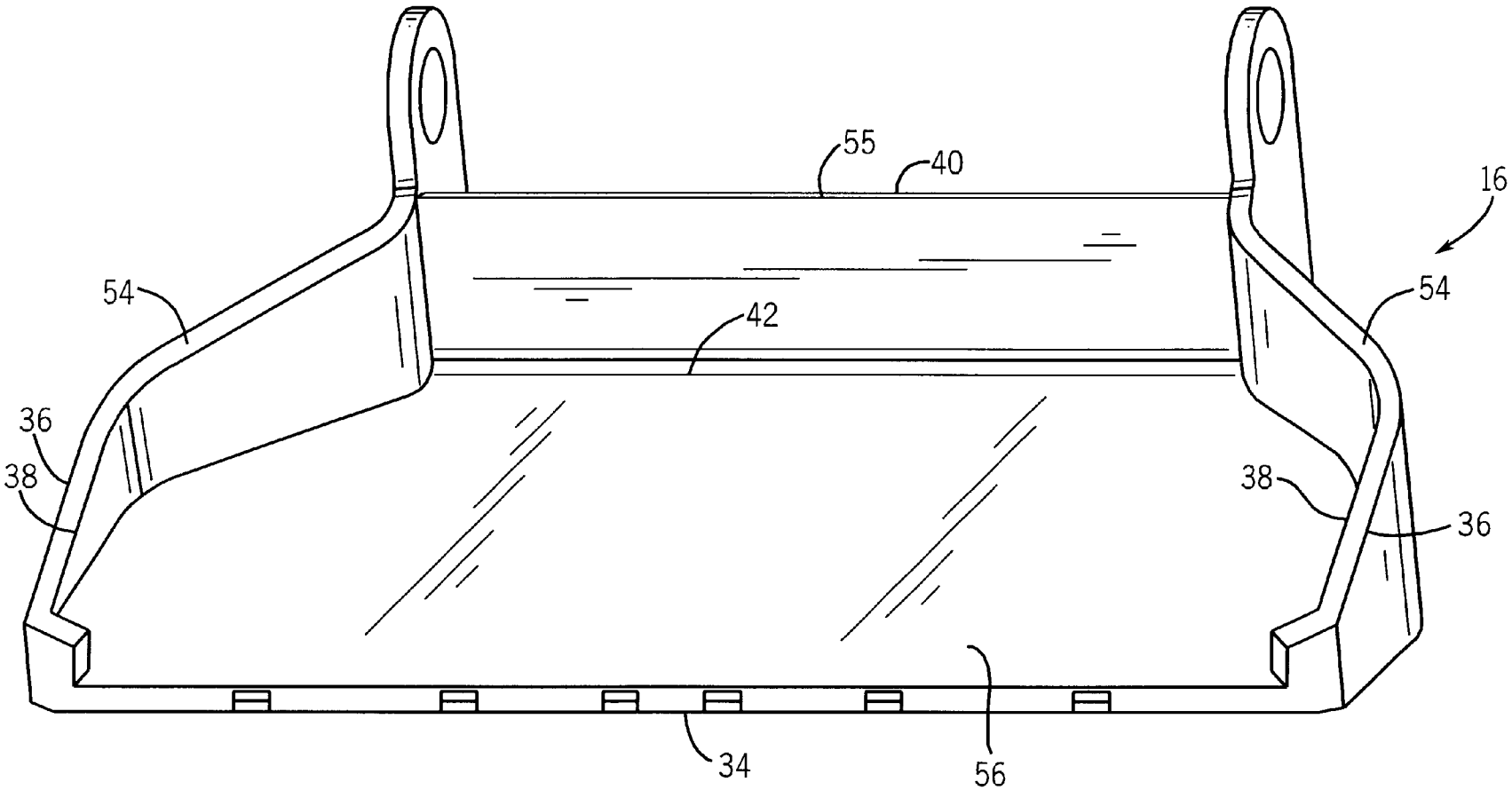
FIG. 2 is a front perspective view of the dipper door of FIG. 1.
Figure 3:
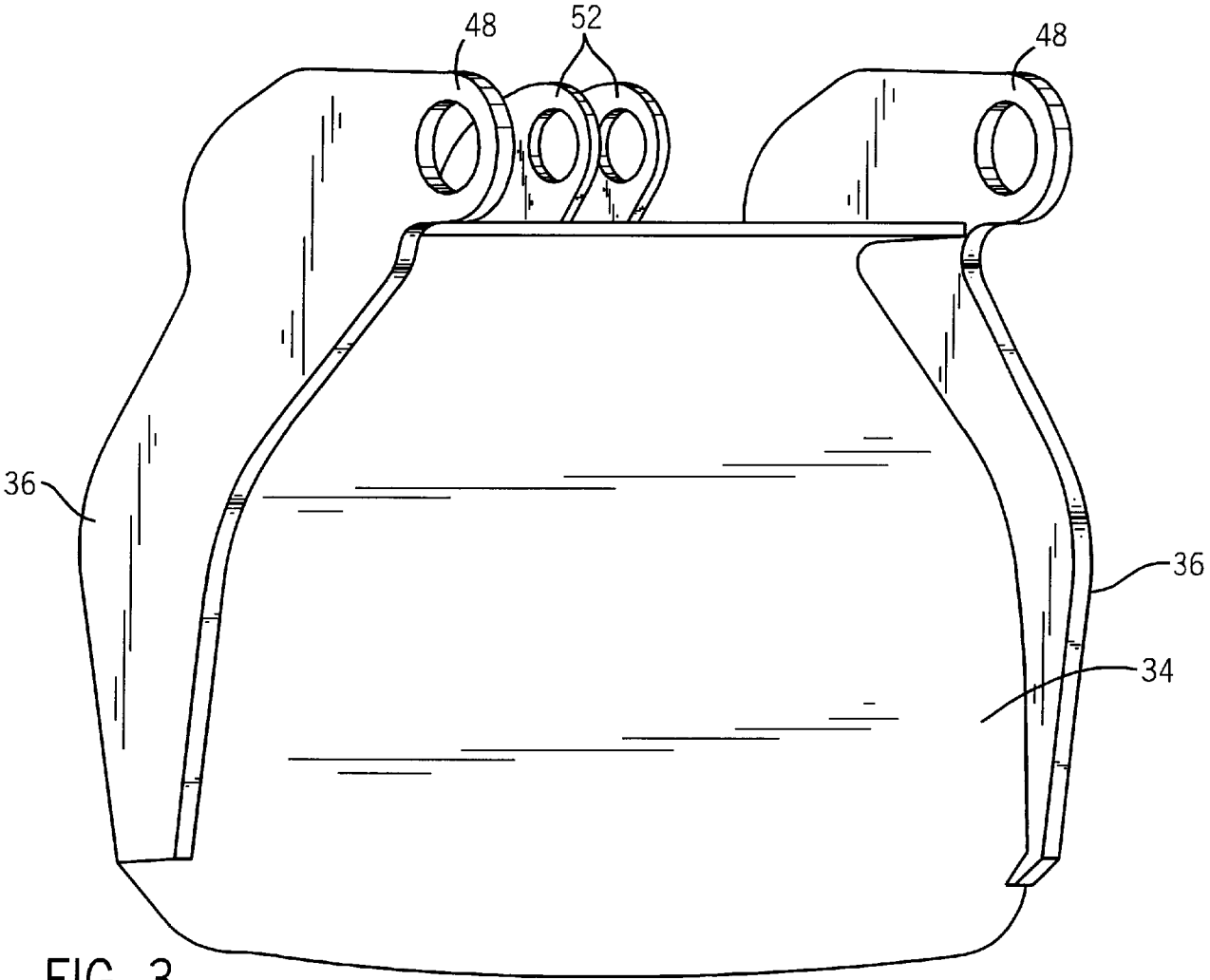
FIG. 3 is a top perspective view of the dipper door of FIG. 1.
Figure 4:
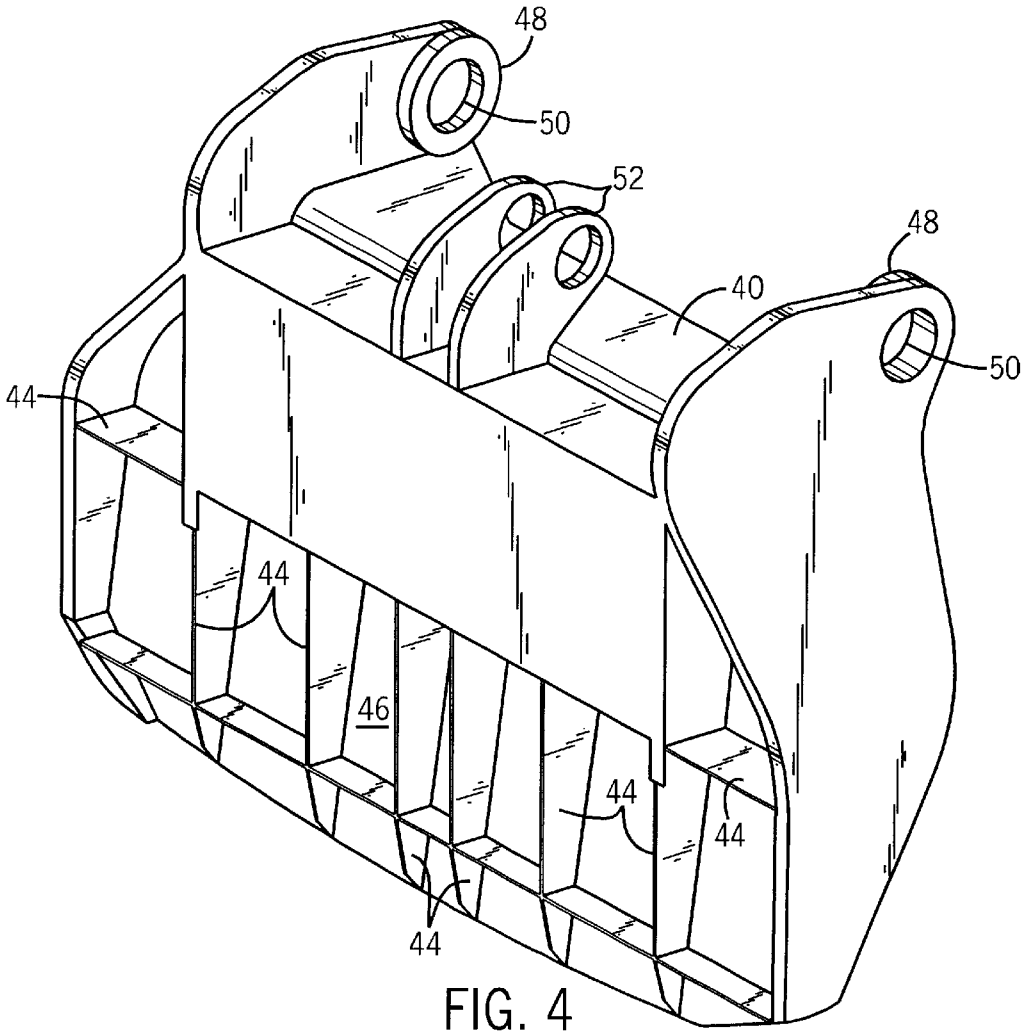
FIG. 4 is a bottom perspective view of the dipper door of FIG. 1.

The dipper door 16 is pivotally connected to the dipper 14, and in a closed position abuts the dipper bottom edges 30, 32 to close the dipper bottom end 20. As shown in FIGS. 2–4, the door 16 is dustpan-shaped having a bottom wall 34, opposing side walls 36 joined to side edges 38 of the bottom wall 34, and a back wall 40 joined to a rear edge 42 of the bottom wall 34 and each side wall 36. Structural members 44 fixed to a bottom surface 46 of the bottom wall 34 and the side walls 36 can be provided to strengthen the door 16. A flange 48 extending rearwardly from each dipper door side wall 36 past the back wall 40 is pivotally connected to the dipper 14 at a pivot point 50, such as by hinges. Lugs 52 extending rearwardly from the back wall 40 provide an attachment point for a linkage 54 controlling the door operation.

The dipper door 16 abuts the dipper wall bottom edges 30, 32 to close the dipper bottom end 20. In particular, top edges 54, 55 of the door side walls 36 and back wall 40 conform to the bottom edges 30, 32 of the dipper side walls 28 and back wall 26, such that the side and rear of the dipper 14 is closed when the door 16 closes the dipper bottom end 20. In the closed position, the top edge of each dipper door side wall 36 abuts the bottom edge 30 of each dipper side wall 38 to close the dipper sides. The top edge 55 of the dipper door back wall 40 abuts the bottom edge 32 of the dipper back wall 26 to close the dipper rear, and the dipper door bottom wall top surface 56 abuts the bottom edge 32 of the dipper front wall 24 to close the front of the dipper 14. In the open position, the door 16 pivots about the pivot point 50 to open the dipper bottom end 20.

The door side walls 36 and back wall 40 extend above the top surface 56 of the bottom wall 34 to increase the structural integrity of the dipper door 16, and define a volume above the bottom wall 34 for holding load material. The volume defined by the door bottom wall top surface 56 and walls 36, 40 provides a dipper assembly 10 having the same volume as a heavier conventional dipper assembly.

The dipper assembly disclosed herein achieves dipper door structural strength using material which in the prior art was dipper wall material, thus reducing the dipper weight and volume while maintaining the dipper door strength and overall volume of the dipper assembly. Advantageously, removing structural dipper material from the dipper 14, and combining the removed structural material with the dipper door 16 facilitates improved load flow into the door hinges.

Preferably, the dipper door pivot point 50 is offset a distance from the dipper bottom end 20 in the direction of the dipper forward end 18. By providing a dipper door pivot point 50 above the dipper bottom end 20, the unload height of the dipper assembly 10 is less than when the dipper door pivot point 50 is at or below the dipper bottom end 20.

The door can be controlled using conventional methods, and as described in copending U.S. patent application Ser. No. 09/606,699, filed on Jun. 29, 2000, which is fully incorporated herein by reference. Preferably, the door is controlled using an actuated linkage which is described in the copending patent application.

While there has been shown and described what are at present considered the preferred embodiments of the invention, it will be obvious to those skilled in the art that various changes and modifications can be made therein without departing from the scope of the invention defined by the appended claims. For example, The dipper door can be provided without a back wall extending above the dipper door top surface, and the dipper door top surface can abut a bottom edge of the dipper back wall to close the dipper back without departing from the scope of the present invention.

I claim:

1. A dipper assembly comprising:

a dipper having a front wall and back wall joined by side walls defining a dipper volume, and having an open bottom defined by bottom edges of said front wall, back wall, and side walls; and a door pivotally linked to said dipper, and having a bottom wall and side walls, said door side walls extending above said bottom wall to define a door volume between said door side walls, said door side walls having top edges which abut said dipper side wall bottom edges when said door extends across said dipper bottom to close said dipper bottom, wherein said door volume combined with said dipper volume defines a total volume of the dipper assembly.

2. The dipper assembly as in claim 1, in which said door is pivotally mounted to said dipper at a pivot point offset a distance from said open bottom in a direction toward said forward end.

3. The dipper assembly as in claim 1, including a door back wall extending upwardly from a back edge of said bottom wall and joined at each end to said door sidewalls to further define said door volume, and a top edge of said door back wall abuts said dipper back wall bottom edge when said door extends across said dipper bottom to close said dipper bottom.

4. A dipper door forming part of a dipper assembly including a dipper having an open bottom, said dipper assembly defining a total dipper volume, said dipper door comprising:

a bottom wall extendible across the dipper bottom for closing said dipper bottom; and side walls extending above said bottom wall to define a door volume between said side walls for carrying a load, and top edges of said side walls are alignable with bottom edges of a dipper bottom to close the dipper bottom and define a portion of the total dipper assembly volume.

5. The dipper door as in claim 4, including a door back wall extending upwardly from a back edge of said bottom wall and joined at each end to said door sidewalls to further define said door volume, wherein a top edge of said door back wall is alignable with one of the dipper wall bottom edges when said side walls are aligned with bottom edges of the dipper bottom to close the dipper bottom.

6. A dipper assembly comprising:

a dipper having a front wall and back wall joined by side walls defining a dipper volume, and having an open bottom defined by bottom edges of said front wall, back wall, and side walls and an open top defined by top edges of said front wall, back wall, and side walls; and a door pivotally linked to said dipper, and having a bottom wall and side walls, said door side walls extending above said bottom wall to define a door volume between said door side walls, wherein said door volume combined with said dipper volume defines a total volume of the dipper assembly.

7. The dipper assembly as in claim 6, in which said door is pivotally mounted to said dipper at a pivot point offset a distance from said open bottom in a direction toward said forward end.

8. The dipper assembly as in claim 6, in which said door side walls having top edges which abut said dipper side wall bottom edges when said door extends across said dipper bottom to close said dipper bottom.

9. The dipper assembly as in claim 6, including a door back wall extending upwardly from a back edge of said bottom wall and joined at each end to said door sidewalls to further define said door volume.

10. The dipper assembly as in claim 9, in which a top edge of said door back wall abuts said dipper back wall bottom edge when said door extends across said dipper bottom to close said dipper bottom.

* * * * *